US005209405A

United States Patent [19]

Robinson et al.

[11] Patent Number: 5,209,405

[45] Date of Patent: May 11, 1993

[54] BAFFLE FOR HVLP PAINT SPRAY GUN

[75] Inventors: Frank A. Robinson, Toledo, Ohio; Albert S. Orr, Indianapolis, Ind.; Marvin D. Burns, Millbury; Alan H. Fritz, Toledo, both of Ohio

[73] Assignee: Ransburg Corporation, Indianapolis, Ind.

[21] Appl. No.: 687,977

[22] Filed: Apr. 19, 1991

[51] Int. Cl.[5] ..... B05B 1/28

[52] U.S. Cl. ..... 239/296; 239/290

[58] Field of Search ..... 239/290, 296, 297, 424, 239/300, 590.3, 590.5, 301, 525-529

[56] References Cited

U.S. PATENT DOCUMENTS

| | | | |
|---|---|---|---|
| 1,990,823 | 2/1935 | Gustafsson | 239/424 |
| 2,303,280 | 11/1942 | Jenkins | 239/296 |
| 2,626,122 | 1/1953 | Lammiman | 239/300 |
| 4,537,357 | 8/1985 | Culbertson et al. | 239/290 |
| 4,993,642 | 2/1991 | Hufgard | 239/300 |
| 5,090,623 | 2/1992 | Burns et al. | 239/301 |

FOREIGN PATENT DOCUMENTS

| | | | |
|---|---|---|---|
| 327296 | 8/1989 | European Pat. Off. . | |
| 381072 | 8/1990 | European Pat. Off. . | |
| 8911932.0 | 1/1990 | Fed. Rep. of Germany . | |
| 2548555 | 1/1985 | France . | |
| 656824 | 9/1951 | United Kingdom | 239/296 |

*Primary Examiner*—Gregory L. Huson
*Assistant Examiner*—Christopher G. Trainor
*Attorney, Agent, or Firm*—MacMillan, Sobanski & Todd

[57] ABSTRACT

A replaceable baffle for dropping high pressure air to low pressure air for atomization and for pattern shaping in a high volume low pressure (HVLP) air paint spray gun. The baffle has a first plurality of orifices for distributing and dropping the air pressure to a low pressure for atomization and has orifices arranged in two stages for dropping the air pressure to a low pressure for pattern shaping. The baffle may be replaced with a baffle having different sized orifices to permit use of different air cap and/or fluid tip designs on the spray gun when applying paints having different flow properties.

12 Claims, 2 Drawing Sheets

BAFFLE FOR HVLP PAINT SPRAY GUN

TECHNICAL FIELD

The invention relates to high volume low pressure (HVLP) air atomization paint spray guns and more particularly to a replaceable baffle for reducing high pressure air to low pressure atomization and pattern shaping air in an HVLP paint spray gun.

BACKGROUND ART

In order to meet environmental regulation in many jurisdictions, there is an increased interest in using spray guns which atomize the paint with a high volume flow of low pressure air. Such guns produce less overspray than spray guns which use a higher velocity high pressure air for achieving atomization. An HVLP paint spray gun is generally defined as a spray gun using air at no greater than 10 psig (0.7 Kg/cm$^2$) at the nozzle for atomization and for pattern shaping. In California, for example, if the spray gun operates with no more than 10 psig at the nozzle, it is exempt from licensing requirements.

There are two general types of HVLP paint spray guns. In one type, an air turbine is used to supply the HVLP air through a relatively large diameter hose to the gun. The large hose can interfere with use of the gun. In a second type of HVLP spray gun, high pressure air is supplied to the gun from a conventional source, such as an air compressor or a compressed air line in a factory. The spray gun has one or more internal orifices for dropping the high air pressure to a low pressure of no more than 10 psig. Difficulty can occur in maintaining the maximum 10 psig pressure in the gun when air flow requirements change. The spray gun requires low pressure air both for atomization and for pattern shaping. During spraying, the atomization air does not change. However, the operator can adjust the flow of pattern shaping air to produce a round pattern where no pattern shaping air is required or a long narrow fan shaped pattern, where a maximum flow of pattern shaping air is required at a pattern between the two extremes. If a single orifice is used to drop the air pressure for both the atomization air and the pattern shaping air, changing the flow of pattern shaping air will result in a change in the pressure drop across the orifice. Consequently, selecting the orifice to produce the maximum 10 psig atomization air when there is no pattern shaping air flow will result in a drop in the atomization air pressure when pattern air flow is increased. The drop in atomization air pressure can adversely affect the quality of the paint atomization. In one improved design HVLP spray gun operated from a source of high pressure air, different fixed orifices are used to drop high air pressure air to a maximum of 10 psig for atomization and for pattern shaping. By using different orifices, a change in the flow of pattern shaping air has little adverse affect on the pressure of the atomization air. However, the orifices have been fixed in the spray gun body. The fixed orifices are calibrated for a particular size fluid tip which discharges the paint and for a particular size air cap which discharges the atomization air and the pattern shaping air. In another type of HVLP spray gun, a pattern shaping air control valve and an atomization air control valve are operated together to maintain a constant atomization air pressure as the pattern shaping air flow is adjusted. These valves also are designed for a particular fluid tip/air cap configuration and are not changeable by the gun operator. Consequently, the prior art HVLP spray guns are suitable for applying only a selected group of paints having flow characteristics matching the design of the fluid tip and the air cap. It has been necessary to have different HVLP spray guns available for applying paints with substantially different flow properties.

Baffles have been used in HVLP spray guns of the type operated from a high pressure air source. The high pressure air is dropped to a low pressure by fixed orifices in the gun body. A baffle has been used to split atomization and shaping air at the front of the spray gun and also to uniformly distribute the low pressure air to pattern shaping orifices on opposite sides of the air cap and to the atomization orifice. Typically, the baffle is designed for minimum pressure drop. Since low pressure air is supplied to the baffle, there may be an uneven pressure drop through the baffle.

DISCLOSURE OF INVENTION

According to the invention, an improved baffle is provided for an HVLP paint spray gun of the type operated from a high pressure air source. The baffle is provided with a plurality of calibrated orifices, some of which drop the high pressure air to low pressure air for atomization and others of which drop the high pressure air to low pressure air for pattern shaping. The pattern shaping air is dropped through a single orifice to an intermediate pressure and then through a plurality of orifices to the maximum 10 psig (0.7 Kg/cm$^2$) for pattern shaping. The orifices uniformly distribute the low pressure air and dampen shock waves to pattern shaping air orifices in the air cap. The flow of pattern shaping air is controlled by a valve located upstream of the first orifice to limit the maximum pattern shaping air pressure, thus permitting a single valve to reduce the flow of pattern shaping air. The atomization air pressure is dropped through a plurality of orifices which uniformly distribute the air flow around the baffle. The low pressure air is discharged from these orifices into an annular distribution chamber formed between the baffle and the fluid tip to impinge against a fixed surface on the baffle. The air then is distributed through a plurality of holes in the fluid tip to provide a uniform flow of atomization air in the nozzle. The fluid tip is screwed onto the spray gun barrel to releasably retain the baffle on the gun barrel. When paint having different properties is to be sprayed with the gun requiring a change in the air cap and/or fluid tip, a different baffle may be attached to the gun barrel to provide the necessary air flow to the nozzle while limiting the air pressure at the nozzle to the 10 psig maximum. Since all of the pressure reduction is accomplished in the baffle, the gun is easily adapted to different materials by merely changing the baffle and the air cap. Thus, the limitation on prior art HVLP spray guns to operation with a single design air cap is avoided.

Accordingly, it is an object of the invention to provide an improved baffle for an HVLP paint spray gun which may be changed to allow the use of different designed air caps and/or fluid tips with the gun, while limiting the maximum pressure at the air cap.

Other objects and advantages of the invention will be apparent from the following detailed description and the accompanying drawings.

BEST MODE FOR CARRYING OUT THE INVENTION

Figure 1:
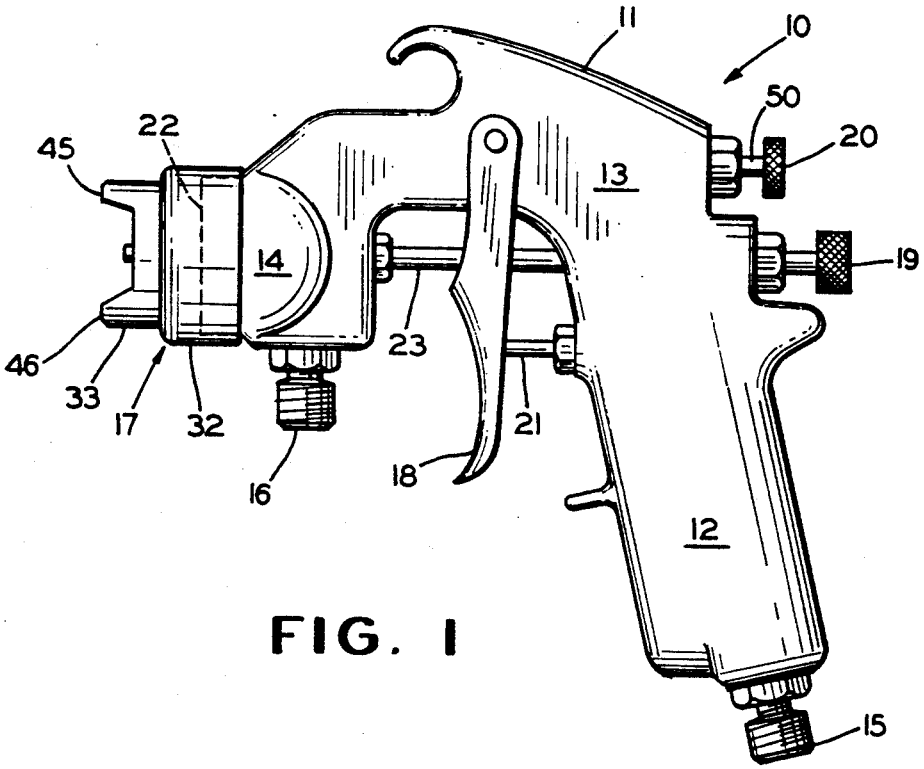
FIG. 1 is a side elevational view of an HVLP paint spray gun according to the invention.

Referring to FIG. 1 of the drawings, a hand held HVLP spray gun 10 is illustrated embodying the invention. The spray gun 10 generally includes a body 11 having a handle 12, a central portion 13 and a barrel 14. A fitting 15 is mounted on the handle 12 for securing a hose connected to a high pressure air source (not shown), such as an air compressor or a compressed air line in a factory. The source air typically is at a pressure of between 25 psig (1.75 Kg/cm$^2$) and 100 psig (7.0 Kg/cm$^2$), with between 40 psig (2.8 Kg/cm$^2$) and 80 psig (5.6 Kg/cm$^2$) most common. A fitting 16 is mounted on the gun barrel 14 for attachment to a paint source (not shown), such as a paint cup secured directly to the fitting 16. Because of the low pressure used to atomize the paint, suction feed may not be adequate and the paint cup is typically pressurized to establish a pressure paint feed to the spray gun 10. The spray gun 10 further includes a nozzle assembly 17 attached to the barrel 14 for atomizing paint, a trigger 18, a paint flow adjustment knob 19 and a pattern shaping air flow adjustment knob 20. As the trigger 18 is squeezed by a gun operator, a valve stem 21 is initially moved to initiate the flow of high pressure air to the nozzle assembly 17 for paint atomization and pattern shaping. According to the invention, a baffle 22 is located between the nozzle assembly 17 and the barrel 14 to reduce the high pressure air received from the remote source to a low pressure, preferably of no more than 10 psig (0.7 Kg/cm$^2$), at the nozzle assembly 17. After the air flow is initiated, further squeezing of the trigger 18 moves a valve needle 23 to initiate the flow of paint to the nozzle assembly 17.

Figure 2:
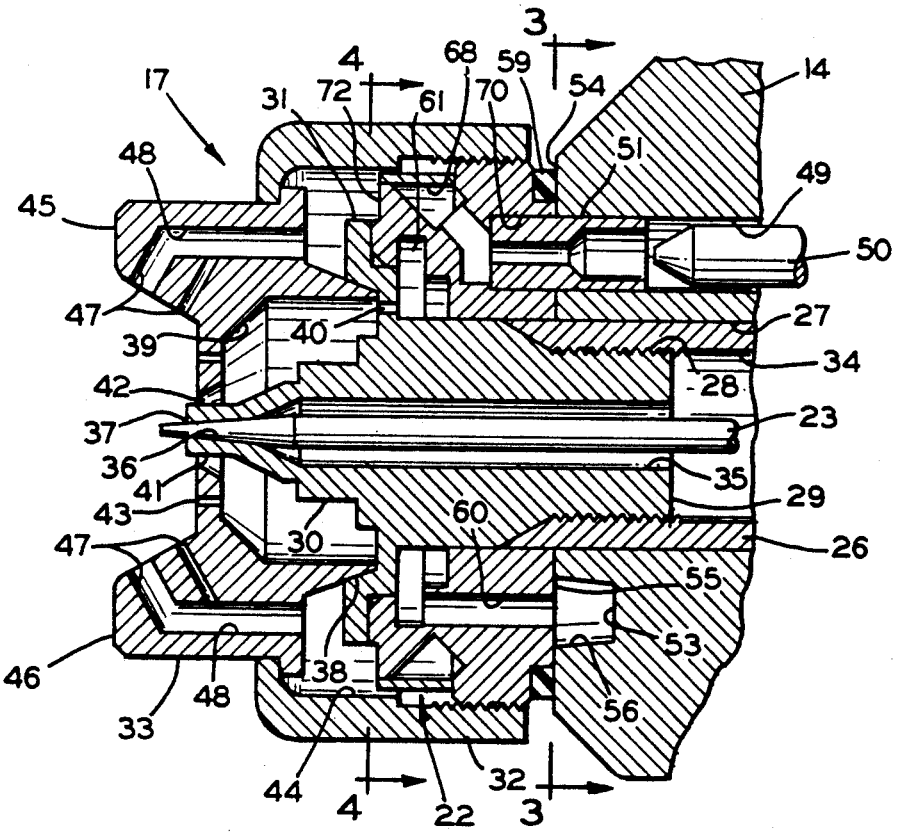
FIG. 2 is an enlarged fragmentary cross sectional view through the air cap, the fluid tip, the baffle and the end of the barrel of the spray gun of FIG. 1.

FIG. 2 is an enlarged cross sectional view showing details of the end of the barrel 14, the nozzle assembly 17 and the baffle 22. An internally threaded tubular sleeve 26 is secured to a passage 27 in the gun barrel 14. The baffle 22 is positioned coaxially around the sleeve 26. An externally threaded end 28 on a fluid tip 29 is threaded into the sleeve 26 to releasably attach the baffle 22 to the gun barrel 14. The fluid tip 29 has a hexagonal portion 30 for receiving a wrench (not shown) to facilitate attaching and removing the fluid tip 29. The fluid tip 29 has a radially extending flange 31 which engages and retains the baffle 22 on the gun barrel 14. Thus, the baffle 22 may be removed and replaced by removing the fluid tip 29 from the barrel 14. A retainer ring 32 is threaded onto the baffle 22 to retain an air cap 33 on the gun barrel 14. The fluid tip 29, the air cap 33 and the retainer ring 32 form the nozzle assembly 17.

Paint is delivered under pressure from the fitting 16 to a chamber 34 within the sleeve 26 in the gun barrel 14. The paint valve needle 23 extends coaxially through the chamber 34, through a chamber 35 in the fluid tip 29 and normally contacts a seat 36 in the fluid tip 29. When the trigger 18 is squeezed, the valve needle 23 moves in an axial direction away from the seat 36 to open a fluid tip orifice 37 through which the pressurized paint is discharged.

Figure 4:
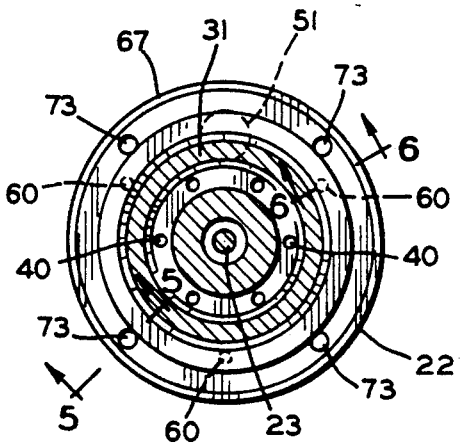
FIG. 4 is a cross sectional view as taken along line 4—4 of FIG. 2, but with the air cap and the air cap retainer ring omitted.
Figure 5:
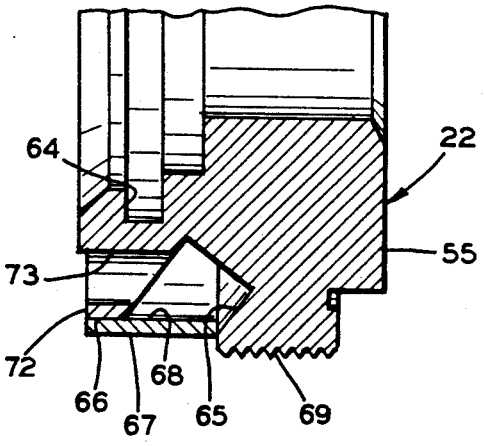
FIG. 5 is an enlarged fragmentary cross sectional view as taken along line 5—5 of FIG. 4.
Figure 6:
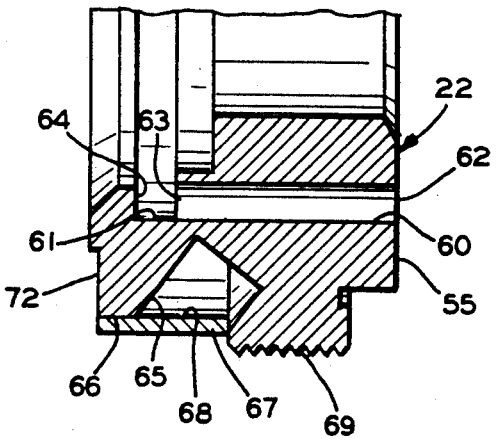
FIG. 6 is an enlarged fragmentary cross sectional view as taken along line 6—6 of FIG. 4.

The air cap 33 delivers an annular flow of atomization air around the discharged paint and also delivers jets of pattern shaping air against diametrically opposite sides of the envelope of atomized paint to flatten the envelope. The air cap 33 has a spherical inner end 38 which seats against the fluid tip 29. An annular atomization air chamber 39 is formed between the air cap 33 and the fluid tip 29. Low pressure atomization air is delivered through a plurality of passages 40 in the fluid tip flange 31 to the chamber 39. As best seen in FIGS. 2 and 4, the passages 40 are spaced around the flange 31 to uniformly distribute the air flow to the chamber 39. The fluid tip 29 has an end 41 which extends coaxially through an opening 42 in the center of the air cap 33. The opening 42 and the fluid tip end 41 form an annular orifice coaxial with the paint orifice 37 through which low pressure air from the chamber 39 discharges to atomize the paint. Optionally, two or more small orifices 43 may extend through the air cap at a location spaced from the opening 42. The orifices 43 provide a low flow of air which prevents paint accumulation on the air cap 33.

Figure 3:
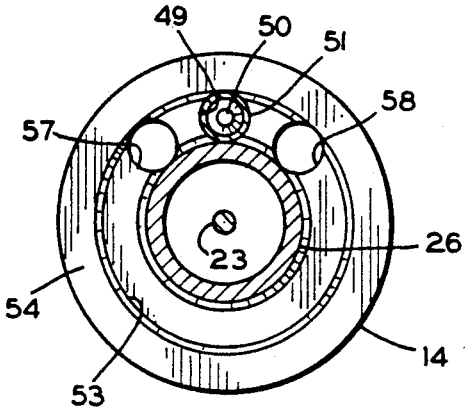
FIG. 3 is a cross sectional view as taken along line 3—3 of FIG. 2.

A pattern shaping air chamber 44 is formed between the air cap 33, the fluid tip flange 31, the baffle 22 and the retainer ring 32. The air cap 33 has two diametrically opposing horns 45 and 46 on opposite sides of the paint discharge orifice 37. Each horn 45 and 46 has one or more orifices 47 (two shown) connected through a passage 48 to the chamber 44. As will be discussed below, a portion of the high pressure air delivered to the gun handle fitting 15 flows through a passage 49 in the gun barrel 14, through the baffle 22 where the pressure drops to a predetermined low pressure, to the pattern shaping air chamber 44 and thence through the passages 48 to the horn orifices 47. The knob 20 on the gun body 11 (FIG. 1) is attached to a pattern shaping air valve needle 50. As shown in FIGS. 2 and 3, a tube 51 attached to the baffle 22 extends into the pattern shaping air passage 49 in the barrel 14. The needle 50 cooperates with the baffle tube 51 for adjusting the pattern shaping air flow between a maximum flow when a maximum flat pattern is desired to no flow when a round pattern is desired. The air cap normally is oriented either as shown with the horns 45 and 46 in a vertical plane for establishing a horizontal pattern for the atomized paint or with the air horns 45 and 46 in a horizontal plane for establishing a vertical pattern for the atomized paint.

As shown in FIGS. 2 and 3, an annular groove 53 is formed in the front face 54 of the barrel 14. The groove 53 is closed by a rear surface 55 on the baffle 22 to form an annular chamber 56. The baffle tube 51 extends through the chamber 56. Two high pressure passages 57 and 58 in the gun barrel 14 supply high pressure atomization air to the chamber 56 on opposite sides of the tube 51. An annular gasket 59 is positioned between the barrel face 54 and the baffle 22 to prevent air pressure leakage from the chamber 56.

Details of the baffle 22 of the invention are illustrated in FIGS. 2, 4, 5 and 6. The baffle 22 has a plurality of long narrow passages 60 (three shown) which deliver atomization air from the chamber 56 to an annular chamber 61 formed between the baffle 22 and the fluid tip 29. The chamber 61 is connected through the fluid tip passages 40 to the chamber 39 and thence to the atomization air opening 42. Each passage 60 has an inlet end 62 at the chamber 56 and an outlet end 63 at the chamber 61. The passages 60 are spaced around the baffle 22 to evenly distribute the air delivered to the chamber 61. Further, each passage outlet end 63 is directed at a radially inwardly directed flange 64 on the baffle 22 to disperse the air in the chamber 61. The passages 60 are calibrated to have a total area which provides the desired pressure drop between the chambers 56 and 61 so that the pressure of the atomization air at the air cap chamber 39 is no greater than a predetermined maximum low pressure, such as no greater than 10 psig (0.7 $Kg/cm^2$). Since the passages 60 supply only atomization air, the air pressure in the chamber 61 is not significantly affected by changes in pattern shaping air flow. Preferably, the passages 60 have a significantly greater length than diameter. By making the passage length 5 or more times greater than the passage diameter, small hole diameter variations in manufacturing tolerances will have a lesser effect on the pressure drop through the passages 60 than if the passage length were short as compared to the diameter.

A groove 65 is formed around the perimeter 66 of the baffle 22. A tubular sleeve 67 is pressed over a portion of the baffle perimeter 66 to cover the groove 65 and form a closed annular chamber 68. The sleeve 67 is slightly smaller in diameter than a threaded portion 69 which receives the air cap retainer ring 32. As shown in FIG. 2, the tube 51 is pressed into an opening 70 in the baffle 22. The tube 51 has a stepped opening 71 which is calibrated to provide a predetermined pressure drop between the gun barrel passage 49 and the baffle chamber 68. When pattern shaping air is flowing, the baffle chamber 68 is at an intermediate pressure between the pressure of the source air at the gun barrel passage 49 and the predetermined low pressure at the chamber 44. The baffle 22 has an annular front surface 72 at the pattern shaping air chamber 44. A plurality of holes 73 (preferably 4 holes 73) are uniformly spaced around the surface 72 to deliver air from the baffle chamber 68 to the chamber 44. The holes 73 are spaced and calibrated to provide a uniform air flow and a predetermined pressure drop between the chambers 68 and 44 to limit the maximum pressure in the chamber 44, preferably to no more than 10 psig (0.7 $Kg/cm^2$). The maximum pressure is present in the chamber 44 when the pattern shaping air valve formed by the needle 50 and the tube 51 is open to allow a maximum air flow. As the needle 50 is moved toward the tube 51, pattern shaping air flow decreases and there will be a corresponding decrease in the pressure in the chambers 68 and 44. By dropping the pattern shaping air from a high pressure to a low pressure in two stages, pressure shock waves are dampened and the air flow is more uniformly distributed to the horn passages 48 than can be achieved with a single stage pressure drop.

It will be noted that the tube 51 always orients the baffle 22 relative to the gun barrel 14. Preferably, the holes 73 are located at 45°, 135°, 225° and 315° relative to a vertical plane through the spray gun 10. During normal spraying with pattern shaping air, the air horns 45 and 46 will be located either at 90° and 270° when spraying with a vertical fan shaped pattern or at 0° and 180° when spraying with a horizontal fan shaped pattern. Consequently, the air horn passages 48 normally will not align with any of the baffle holes 73.

It has been found that when there is a significant air pressure drop through an orifice, for example, a drop of from about 50 psig or more to about 10 psig, the discharge air flow velocity is supersonic near the orifice. One consequence of supersonic discharge of air is the formation of stationary shock waves, which results from deceleration of the high velocity stream. Such shock waves can cause spray pattern distortion as a consequence of strong local pressure gradients resulting in unequal or unsymmetrical flow of air through the shaping air orifices 47 and/or the annular atomization air orifice 42. For atomization air, the multiple passages 60 with a high aspect ratio serve to eliminate or reduce the effect of stationary shock waves in the flow leading to the annular orifice 42 in the air cap 33. For the pattern shaping air flow, the intermediate annular chamber 61 serves to contain the stationary shock waves while maintaining an intermediate pressure that assures an even flow into the chamber 44 behind the air cap 33 that is always subsonic and therefore free of shock waves.

It will be appreciated that various modifications and changes may be made to the above described preferred embodiment of the HVLP spray gun 10 and of the baffle 22 without departing from the spirit and the scope of the following claims. In its broadest aspects, the invention covers a baffle for an HVLP spray gun which is replaceable. The baffle has a plurality orifices which provide separate air pressure drops to establish low pressure air at a predetermined maximum pressure for atomization and for pattern shaping. The orifices are calibrated for a specific maximum source air pressure and for a particular air cap design having specific size orifices for discharging atomization air and pattern shaping air. Different air cap designs may be used with the spray gun merely by changing the baffle to one matched to supply the air flow requirements of the air cap. It also will be appreciated that although the spray gun 10 has been described as having no greater than 10 psig (0.7 $Kg/cm^2$) air pressure at the nozzle assembly 17, other maximum low air pressures may be established to satisfy local regulatory requirements.

We claim:

1. In a fluid spray gun of the type operated from a source of high pressure air and using a high volume low pressure flow of air at a nozzle for fluid atomization and for pattern shaping, said spray gun nozzle having a first chamber for receiving atomization air and a second chamber for receiving pattern shaping air, the improvement comprising a replaceable baffle located in said spray gun between the high pressure air source and said nozzle, said baffle including at least one first calibrated orifice between the source of high pressure air and said first chamber, said at least one first orifice reducing the pressure of a first flow of the high pressure air for atomization from the high pressure source to no greater than a predetermined low pressure lower than the high pressure and delivering such first flow to said first chamber, and wherein said baffle includes at least one second calibrated orifice between the source of high pressure air and said second chamber, said at least one second orifice reducing the pressure of a second flow of the high pressure air for pattern shaping from the high pressure source to no greater than a predetermined low pressure lower than the high pressure and delivering such second flow to said second chamber.

2. In a spray gun of the type connected to a source of high pressure air and using a high volume low pressure flow of air at a nozzle for atomization and for pattern shaping, a replaceable baffle as set forth in claim 1, and wherein said baffle is annular and wherein said at least one second calibrated orifice comprises a plurality of said second orifices spaced around said baffle to distribute pattern shaping air delivered to said second chamber.

3. In a fluid spray gun of the type operated from a source of high pressure air and using a high volume low pressure flow of air at a nozzle for fluid atomization and for pattern shaping, and spray gun nozzle having a first chamber for receiving atomization air and a second chamber for receiving pattern shaping air, the improvement comprising a replaceable baffle located in said spray gun between the high pressure air source and said nozzle, said baffle including at least one first calibrated orifice between the source of high pressure air and said first chamber, sand at least one first orifice delivering a flow of atomization air form the high pressure source to said first chamber at no greater than a predetermine low pressure lower than the high pressure, wherein said baffle includes at least one second calibrated orifice between the source of high pressure air and said second chamber, said at least one second orifice delivering a flow of pattern shaping air from the high pressure source to said second chamber at no greater than a predetermined low pressure lower than the high pressure and wherein said baffle is annular and has a plurality of first orifices spaced around said baffle for distributing the air delivered to said first chamber and an annular flange located on said baffle in said first chamber opposite and air discharge end of each of said first orifices, and wherein air discharged from said first orifices impinges against said annular flange.

4. In a spray gun of the type connected to a source of high pressure air and using a high volume low pressure flow of air at a nozzle for atomization and for pattern shaping, a replaceable baffle as set forth in claim 3, wherein each of said first orifices has a length at least 5 time its diameter.

5. In a spray gun of the type connected to a source of high pressure air and using a high volume low pressure flow of air at a nozzle for atomization and for pattern shaping, a replaceable baffle as set forth in claim 3, and wherein each of said first orifices has a length to diameter ratio sufficient to prevent shock waves int he air flow delivered to said first chamber.

6. In a fluid spray gun of the type operated from a source of high pressure air and using a high volume low pressure flow of air at a nozzle for fluid atomization and for pattern shaping, said spray gun nozzle having a first chamber for receiving atomization air and a second chamber for receiving pattern shaping air, the improvement comprising a replaceable annular baffle located in said spray gun between the high pressure air source and said nozzle, said baffle including at least one first calibrated orifice between the source of high pressure air and said first chamber, said at least one first orifice reducing the pressure of a first flow of the high pressure air for atomization from the high pressure source to no greater than a predetermined low pressure lower than the high pressure and delivering such first flow to said first chamber, and wherein said baffle includes a plurality of second calibrated orifices between the source of high pressure air and said second chamber, said second orifices reducing the pressure of a second flow of the high pressure air for pattern shaping from the high pressure source to no greater than a predetermined low pressure lower than the high pressure and delivering such second flow to said second chamber, said second orifices being spaced around said baffle to distribute pattern shaping air delivered to said second chamber, and wherein said baffle has an annular internal chamber connected to an inlet end of each of said second orifices, and including a third orifice on said baffle located between said internal chamber and the source of high pressure air, said third orifice dropping the pressure of the high pressure air to an intermediate pressure and said second orifices dropping the pressure of said intermediate pressure air to a pressure no greater than said predetermined low pattern shaping air pressure.

7. In a spray gun of the type connected to a source of high pressure air and using a high volume low pressure low of air at a nozzle for atomization and for pattern shaping, a replaceable baffle as set forth in claim 6, and including means in said spray gun cooperating with said third orifice for adjusting the flow of pattern shaping air through said third orifice to adjust the pattern of fluid atomized by said spray gun.

8. In a spray gun of the type connected to a source of high pressure air and using a high volume low pressure flow of air at a nozzle for atomization and for pattern shaping, a replaceable baffle as set forth in claim 6, wherein said internal chamber contains any stationary shock waves in the air flow discharged from said third orifice and wherein said second orifices are sized and spaced to distribute and limit the velocity of air flow to said second chamber to a subsonic level.

9. In a fluid spray gun of the type operated from a source of high pressure air and using a high volume low pressure flow of air at a nozzle for fluid atomization and for pattern shaping, said spray gun nozzle having a first chamber for receiving atomization air and a second chamber for receiving pattern shaping air, the improvement comprising a replaceable baffle located in said spray gun between the high pressure air source and said nozzle, said baffle including at least one first calibrated orifice between the source of high pressure air and said first chamber, said at least one first orifice delivering a flow of atomization air from the high pressure source to said first chamber at no greater than a predetermined low pressure lower than the high pressure, wherein said baffle includes at least one second calibrated orifice between the source of high pressure air and said second chamber, said at least one second orifice delivering a flow of pattern shaping air from the high pressure source to said second chamber at no greater than a predetermined low pressure lower than the high pressure, said baffle having an annular internal chamber connected to an inlet end of each of said second orifices, a third orifice on said baffle located between said internal chamber and the source of high pressure air, said third orifice dropping the pressure of the high pressure air to an intermediate pressure and said second orifices dropping the pressure of said intermediate pressure air to a pressure no greater than said predetermined low pattern shaping air pressure, and wherein said at least one first calibrated orifice comprises a plurality of first orifices paced around said baffle for distributing the air delivered to said first chamber and an annular flange located on said baffle in said first chamber opposite an air discharge end of each of said first orifices, and wherein air discharged from said first orifices impinges against said annular flange.

10. In a spray gun of the type connected to a source of high pressure air and using a high volume low pressure flow of air at a nozzle for atomization and for pattern shaping, a replaceable baffle as set forth in claim 9, and wherein said first orifices consists of three orifices having the same size and wherein said second orifices consists of four orifices having the same size.

11. In a spray gun of the type connected to a source of high pressure air and using a high volume low pressure flow of air to at nozzle for atomization and for pattern shaping, a replaceable baffle as set forth in claim 10, and wherein said four second orifices are located at angles of 45°, 135°, 225° and 315° relative to a vertical plane through said spray gun, whereby said second orifices are not aligned with pattern shaping air ports in said spray gun nozzle while spraying with vertically and horizontally oriented patterns.

12. In a fluid spray gun of the type operated from a source of high pressure air and using a high volume low pressure flow of air at a nozzle for fluid atomization and for pattern shaping, said spray gun nozzle having a first chamber for receiving atomization air and a second chamber for receiving pattern shaping air, the improvement comprising a replaceable baffle located in said spray gun between the high pressure air source and said nozzle, said baffle including at least one first calibrated orifice between the source of high pressure air and said first chamber, said at least one first orifice reducing the pressure of a first flow of the high pressure air for atomization from the high pressure source to no greater than a predetermined low pressure lower than the high pressure and delivering such first flow to said first chamber, and wherein said baffle includes at least one second calibrated orifice between the source of high pressure air and said second chamber, said at least one second orifice reducing the pressure of a second flow of the high pressure air for pattern shaping form the high pressure source to no greater than a predetermined low pressure lower than the high pressure and delivering such second flow to said second chamber, and wherein said baffle includes means for preventing shock waves int he air delivered through said baffle to said first and second chambers.

* * * * *